US008353182B2

(12) United States Patent
Triffle

(10) Patent No.: US 8,353,182 B2
(45) Date of Patent: Jan. 15, 2013

(54) SAFETY LOCKOUT HASP

(75) Inventor: Geoffrey Michael Triffle, Vermont South (AU)

(73) Assignee: Assa Abloy Australia Pty Limited, Oakleigh (AT)

( * ) Notice: Subject to any disclaimer, the term of this patent is extended or adjusted under 35 U.S.C. 154(b) by 10 days.

(21) Appl. No.: 13/110,170

(22) Filed: May 18, 2011

(65) Prior Publication Data

US 2011/0283753 A1 Nov. 24, 2011

(30) Foreign Application Priority Data

May 18, 2010 (AU) ..... 2010902181

(51) Int. Cl.
*E05B 73/00* (2006.01)

(52) U.S. Cl. ..... 70/14; 70/19; 70/DIG. 63

(58) Field of Classification Search ..... 70/14, 18–19, 70/51, 53, 58, DIG. 63
See application file for complete search history.

(56) References Cited

U.S. PATENT DOCUMENTS

| | | | | | |
|---|---|---|---|---|---|
| 1,197,020 | A | | 9/1916 | Farrar | |
| 2,560,624 | A | * | 7/1951 | Bartlett | 70/14 |
| 2,963,895 | A | * | 12/1960 | Thomas | 70/14 |
| 3,667,259 | A | | 6/1972 | Reque et al. | |
| 4,085,599 | A | * | 4/1978 | Fischer | 70/14 |
| 4,409,804 | A | | 10/1983 | Sork | |
| 4,864,834 | A | * | 9/1989 | Waite | 70/14 |
| 5,020,342 | A | * | 6/1991 | Doan et al. | 70/14 |
| 5,167,135 | A | * | 12/1992 | Gobeski | 70/14 |
| 5,365,757 | A | | 11/1994 | Primeau | |
| 5,582,042 | A | * | 12/1996 | Mordick | 70/14 |
| 5,743,116 | A | * | 4/1998 | Suster | 70/14 |
| 5,881,582 | A | * | 3/1999 | Monaco | 70/14 |
| 5,907,962 | A | | 6/1999 | Smithson et al. | |
| 5,956,980 | A | * | 9/1999 | Jenkins, Jr. | 70/18 |
| 6,530,248 | B1 | * | 3/2003 | Parker | 70/14 |
| 7,124,606 | B2 | * | 10/2006 | Turek | 70/14 |
| 2005/0028569 | A1 | | 2/2005 | Turek | |

FOREIGN PATENT DOCUMENTS

| | | | |
|---|---|---|---|
| EP | 0831199 | A2 | 3/1998 |
| WO | WO 02/077901 | A2 | 10/2002 |

OTHER PUBLICATIONS

International-Type Search Report prepared by the Australian Patent Office for National Application No. 2010902181; Applicant, Assa Abloy Australia Pty Limited.

* cited by examiner

*Primary Examiner* — Christopher Boswell
(74) *Attorney, Agent, or Firm* — Sheridan Ross P.C.

(57) ABSTRACT

This invention relates to a safety lockout hasp 1 which includes a body 2 and a moveable member 3. The moveable member 3 includes a plurality of apertures 7 which are each capable of accommodating the shackle 16 of a lock means 8. The apertures 7 are only accessible when the moveable member is in a closed position. The moveable member 3 can only be moved to an open condition when the locking means 8 is detached from the hasp 1.

25 Claims, 2 Drawing Sheets

SAFETY LOCKOUT HASP

This invention relates to a safety lockout hasp for preventing the release of energy to plant. Throughout this specification the use of the term plant is intended to be a general term for equipment, infrastructure, machinery, appliances, tools and implements. The invention has been developed for use in the preventing the release of electrical energy to machinery and it will be convenient to hereinafter describe the invention with reference to this particular application. It is to be appreciated however that the hasp may be used on to prevent other forms of energy such as fuels, fluids under pressure or the like.

The supply of electrical energy to a machine often needs to be interrupted to allow for maintenance on the components of the machine. The person conducting the maintenance may need to access parts of the machine that could be harmful if energy is being supplied to the machine. The machine may have exposed electrical terminals, or the electrical energy may cause movement to the components that could cause physical harm to the person. The machine may be of such a size that the person is maintaining a part of the machine that is remote from the electrical switch, and the switch may be inadvertently turned on causing harm to the person maintaining the machine. Alternatively multiple people may be conducting separate maintenance tasks on the machine, and it may not be clear that all those tasks are complete. One person may have left to collect replacement parts only to have the switch turned on in their absence. This may cause damage to the person when they return, or even damage the machine. It is therefore desirable to lockout the machine from the electricity source.

The switch controlling the supply of electrical energy to the machine is often located within a box, whereby the lid to the box can be locked in a closed position with a padlock. The box may include a metal hoop, often referred to as a staple, which fits through an opening in the lid and receives the shackle of the padlock. Alternatively the switch may include an aperture, which is exposed when the switch is in an "off" position, that accommodates the shackle to prevent it being moved to the "on" position. It is generally desirable for each person maintaining the machine to have their own padlock, however the size of the aperture or staple will generally only accommodate a single shackle. Where more than one person is maintaining the machine, it is preferred to provide a safety lockout hasp as it can accommodate more than one padlock.

A safety lockout hasp generally includes a shackle that can be attached to the aperture or staple. The shackle of the hasp can be moved to an open condition for attaching the hasp to the staple, and then moved to a closed position. The shackle of the hasp is retained in its closed position when a padlock is secured to the hasp. The hasp includes a plurality of apertures, each aperture for accommodating the shackle of a padlock. The plurality of apertures allows each person maintaining the machine to attach their padlock to the hasp, so that the shackle of the hasp can not be moved to the open condition without each of the padlocks being removed.

A problem with existing hasps is that the padlock can be attached to the hasp without the shackle of the hasp being in the closed condition. This can result in the hasp being attached to the machine, a padlock being attached to the hasp, and yet the hasp is still not in a closed condition. This will allow for the hasp to be detached from the machine while a padlock is attached, and more critically allow for electricity to be supplied to the machine.

A reference herein to a patent document or other matter which is given as prior art is not to be taken as an admission that that document or matter was, in Australia, known or that the information it contains was part of the common general knowledge as at the priority date of any of the claims.

According to this invention there is provided a safety lockout hasp for preventing the release of energy to plant, the hasp including a body, a movable member having an engaging portion for engaging the plant, the movable member being movable relative to the body between open condition whereby the engaging portion can engage and disengage from the plant, and a closed condition whereby the engaging portion is prevented from engaging and disengaging from the plant, the movable member interacting with the body such that when the movable member is in the closed condition the hasp can accommodate a plurality of locking means to prevent movement of the movable member from the closed position, and when the movable member is in the open condition the hasp is prevented from accommodating the at least one locking means.

It is preferred that the movable member includes a lock receiving portion to which the at least one locking means can be attached. The lock receiving portion preferably includes a plurality of apertures each extending from a face of the lock receiving portion, with each aperture configured to accommodate one of the locking means. It is preferred that the face of the lock receiving portion is substantially perpendicular with a direction of movement of the movable member. It is further preferred that the locking means is a padlock and each aperture in the lock receiving portion is configured to accommodate a shackle portion of the padlock. It is still further preferred that the shackle of the padlock abuts the body when preventing movement of the movable member from the closed position.

It is preferred that a first end of the movable member is connected to the body. It is preferred that the first end of the movable member is pivotally connected to the body. It is preferred that a second end of the movable member is movable relative to the body so as to be relatively adjacent the body when the movable member is in a closed condition, and relatively spaced from the body when the movable member is in the open condition. It is still further preferred that the first end of the movable member is attached to one side of the body, and the second end is positioned on an opposed side of the body to the first end when the movable member is in the closed condition.

It is preferred that the body includes a tab which in part defines a slot which accommodates the movable member at or adjacent the second end when the movable member is in the closed condition. It is preferred that the tab prevents movement of the movable member in a direction perpendicular to the movement of the movable member when moving between the open and closed condition.

It is preferred that the body includes a pair of stops that limit movement of the movable member between the open and closed conditions. It is further preferred that each stop is in the form of a flange extending in a direction perpendicular to the direction of movement of the movable member when moving between the open condition and the closed condition. It is still further preferred that the body includes a planar face across which the movable member passes when moving between the closed condition and the open condition.

It will be convenient to hereinafter describe the invention in greater detail with reference to the attached drawings. The particularity of the drawings and detailed description is not intended to supersede the generality of the preceding broad description of the invention.

Figure 1:
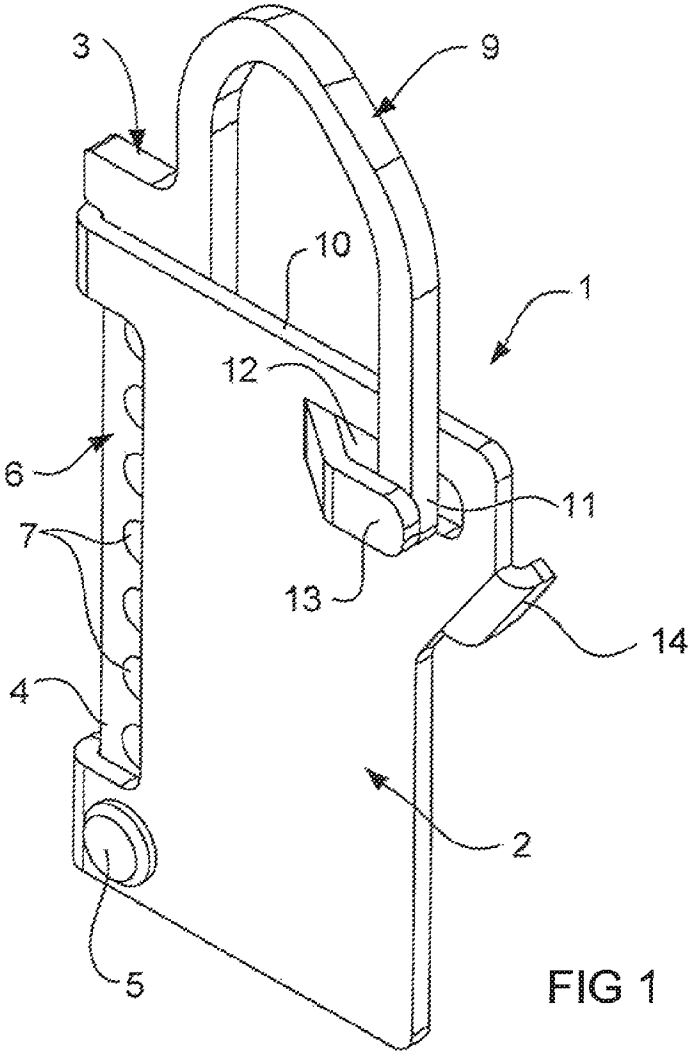
FIG. 1 illustrates an isometric view of a preferred embodiment of a safety lockout hasp according to the invention.

FIG. 1 illustrates a preferred embodiment of a safety lockout hasp 1 which includes a body 2 and a movable member 3 in a closed condition. The movable member 3 illustrated has a fixed end 4 attached by a stud 5 to the body 2 however the stud 5 may be substituted by some other form of fastener such as a nut and bolt. The movable member 3 also includes a lock receiving portion 6 which extends away from the fixed end 4. The lock receiving portion 6 includes a plurality of apertures 7, each aperture 7 for receiving an individual padlock 8 (see FIG. 3). FIG. 1 illustrates the lock receiving portion including seven apertures 7 however this number may vary. It should be noted form FIG. 1 that passage through the apertures 7 is not obstructed by the body 2 when the movable member 3 is in the closed condition.

The movable member includes a portion 9 which in use engages the plant. The engaging portion 9 illustrated in FIG. 1 is in the form of a shackle 9 which extends away from the lock receiving portion 6. The shackle 9 is positioned relative to the body 2 so as to extend from one side of the body 2, over a top edge 10 to the other side of the body 2. The shackle 9 has a free end 11 which is accommodated within a slot 12 defined between the body 2 and a tab 13 when the movable member 3 is in the closed condition. The inclusion of the tab 13 prevents movement of the free end 11 of the shackle 9 in a direction perpendicular to the side of the body 2. This prevents the hasp 1 being detached from the plant by twisting of the shackle 9 relative to the body 2. Capturing the free end 11 of the shackle 9 may be achieved in a number of ways, and the arrangement of the tab 13 extending out one side of the body 2 is merely preferred. Alternatively a slot may be formed within the plane of the body 2 and shackle may have a dog leg bend proximate its free end 11 which is located within the slot.

Figure 2:
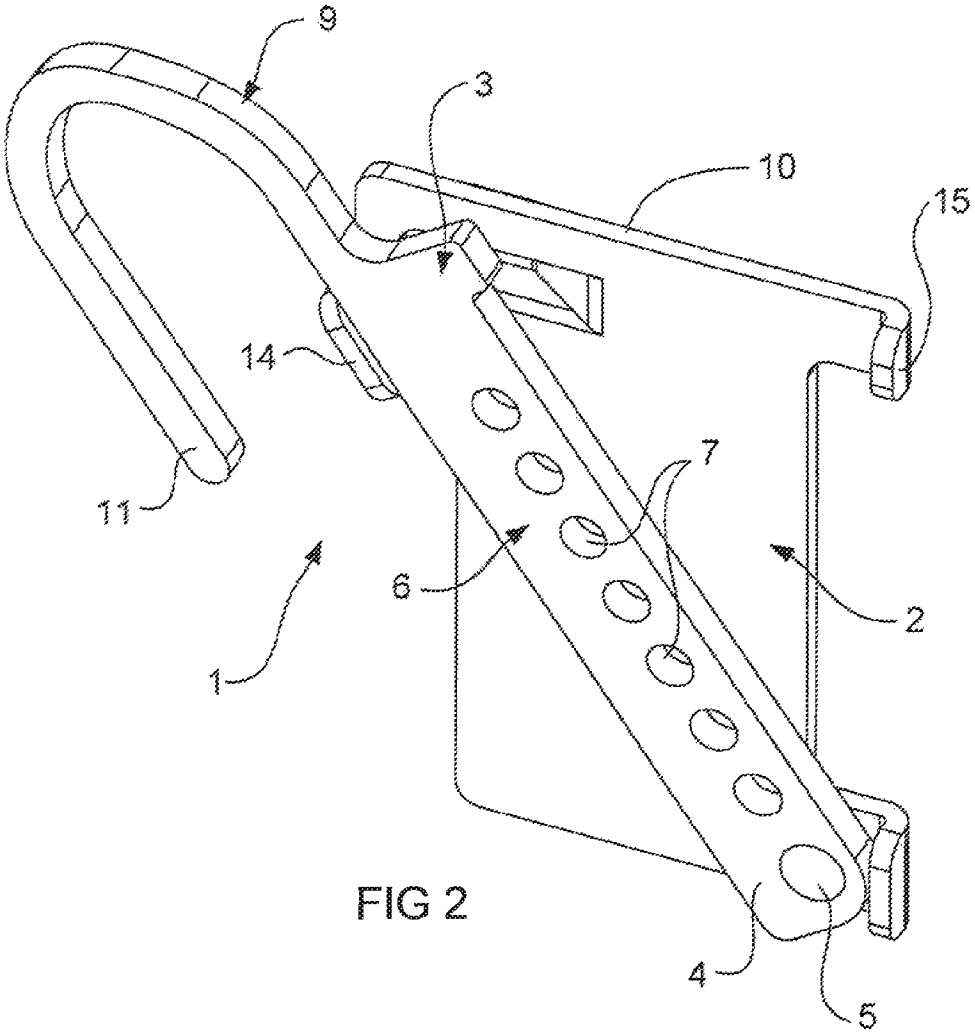
FIG. 2 is a rear isometric view of the hasp from FIG. 1 with the movable member in an open condition.

FIG. 2 illustrates the movable member 3 in an open condition, so that in use it can be attached and detached from the plant. The open condition is reached by pivoting the movable member 3 about the stud 5 until it engages a stop associated with an edge of the body 2. The stop 14 illustrated is in the form of a flange to which engages the lock receiving portion 6 to limit pivoting movement of the movable member 3. The stop 14 arrangement illustrated could take other forms.

It should be noted from FIG. 2 that whilst the movable member 3 is in the open condition, the lock receiving portion 6 is flush with a side of the body 2. More specifically passage through each aperture 7 is obstructed by the body 2 when the movable member 3 is in the open condition. This arrangement prevents attaching the padlock 8 to the lock receiving portion 6 when the movable member 3 is in the open condition.

Figure 3:
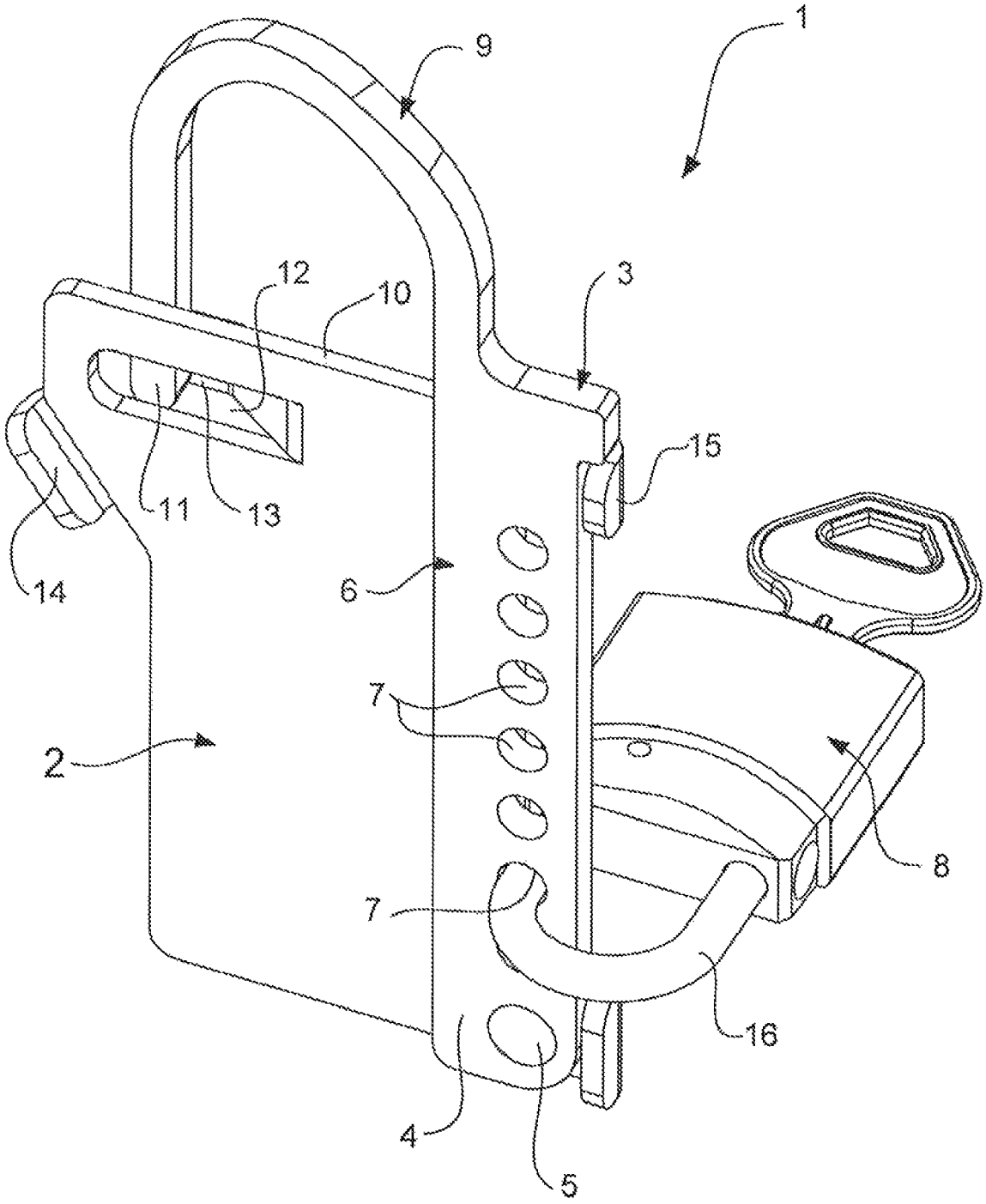
FIG. 3 is a rear isometric view of the hasp from FIG. 1 with the movable member in a closed condition accommodating a padlock.

Referring now to FIG. 3 which illustrates the movable member 3 again in the closed position whereby an upper edge of the lock receiving portion 6 is engaging a further stop 15 on the body 2. This stop 15 prevents further movement of the movable member 3 once the movable member 3 is in the closed condition. Again the stop 15 is in the form of a flange.

Once the movable member 3 is in the closed condition a shackle 16 of the padlock 8 can be inserted through any one of the apertures 7 and the padlock 8 locked. The shackle 16 of the padlock 8 will abut an edge of the body 2 in the event that the movable member 3 is urged to move from the closed condition towards the open condition.

Whilst FIG. 3 illustrates a padlock 8, it ought to be appreciated that any form of locking means may be suitable.

A safety lock out hasp as hereinbefore described has the benefit of preventing attachment of a padlock 8 when the movable member 3 is in an open condition.

Various alterations and/or additions may be introduced to the safety lockout hasp as hereinbefore described without departing from the spirit or ambit of the invention.

The claims defining the invention are as follows:

1. A safety lockout hasp for preventing the release of energy to plant, the hasp including, a body, a movable member having an engaging portion for engaging the plant, the movable member being movable relative to the body between open condition whereby the engaging portion can engage and disengage from the plant, and a closed condition whereby the engaging portion is prevented from engaging and disengaging from the plant, the movable member interacting with the body such that when the movable member is in the closed condition the hasp can accommodate at least one locking means to prevent movement of the movable member from the closed position, and when the movable member is in the open condition the hasp cannot accommodate any of the plurality of locking means.

2. A safety lockout hasp according to claim 1 wherein the movable member includes a lock receiving portion to which the at least one locking means can be attached.

3. A safety lockout hasp according to claim 2 wherein the lock receiving portion includes a plurality of apertures each extending from a face of the lock receiving portion, with each aperture configured to accommodate one of the locking means.

4. A safety lockout hasp according to claim 3 wherein the face of the lock receiving portion is substantially perpendicular with a direction of movement of the movable member.

5. A safety lockout hasp according to claim 4 wherein the locking means is a padlock and each aperture in the lock receiving portion is configured to accommodate a shackle portion of the padlock.

6. A safety lockout hasp according to claim 5 wherein the shackle of the padlock abuts the body when preventing movement of the movable member from the closed position.

7. A safety lockout hasp according to claim 6 wherein a first end of the movable member is connected to the body.

8. A safety lockout hasp according to claim 7 wherein the first end of the movable member is pivotally connected to the body.

9. A safety lockout hasp according to claim 8 wherein a second end of the movable member is movable relative to the body so as to be relatively adjacent the body when the movable member is in a closed condition, and relatively spaced from the body when the movable member is in the open condition.

10. A safety lockout hasp according to claim 9 wherein the first end of the movable member is attached to one side of the body, and the second end is positioned on an opposed side of the body to the first end when the movable member is in the closed condition.

11. A safety lockout hasp according to claim 10 wherein the body includes a tab which in part defines a slot which accommodates the movable member at or adjacent the second end when the movable member is in the closed condition.

12. A safety lockout hasp according to claim 11 wherein the tab prevents movement of the movable member in a direction perpendicular to the movement of the movable member when moving between the open and closed condition.

13. A safety lockout hasp according to claim 12 wherein the body includes a pair of stops that limit movement of the movable member between the open and closed conditions.

14. A safety lockout hasp according to claim 13 wherein each stop is in the form of a flange extending in a direction perpendicular to the direction of movement of the movable member when moving between the open condition and the closed condition.

15. A safety lockout hasp according to claim 14 wherein the body includes a planar face across which the movable member passes when moving between the closed condition and the open condition.

16. A safety lockout hasp according to claim 1 wherein a first end of the movable member is connected to the body.

17. A safety lockout hasp according to claim 16 wherein the first end of the movable member is pivotally connected to the body.

18. A safety lockout hasp according to claim 17 wherein a second end of the movable member is movable relative to the body so as to be relatively adjacent the body when the movable member is in a closed condition, and relatively spaced from the body when the movable member is in the open condition.

19. A safety lockout hasp according to claim 18 wherein the first end of the movable member is attached to one side of the body, and the second end is positioned on an opposed side of the body to the first end when the movable member is in the closed condition.

20. A safety lockout hasp according to claim 19 wherein the body includes a tab which in part defines a slot which accommodates the movable member at or adjacent the second end when the movable member is in the closed condition.

21. A safety lockout hasp according to claim 20 wherein the tab prevents movement of the movable member in a direction perpendicular to the movement of the movable member when moving between the open and closed condition.

22. A safety lockout hasp according to claim 1 wherein the body includes a pair of stops that limit movement of the movable member between the open and closed conditions.

23. A safety lockout hasp according to claim 22 wherein each stop is in the form of a flange extending in a direction perpendicular to the direction of movement of the movable member when moving between the open condition and the closed condition.

24. A safety lockout hasp according to claim 1 wherein the body includes a planar face across which the movable member passes when moving between the closed condition and the open condition.

25. A safety lockout hasp according to claim 1 wherein when the movable member is in the closed position the hasp can accommodate a plurality of locking means.

* * * * *